US005202649A

United States Patent [19]

Kashiwa

[11] Patent Number: 5,202,649

[45] Date of Patent: Apr. 13, 1993

[54] MICROWAVE INTEGRATED CIRCUIT DEVICE HAVING IMPEDANCE MATCHING

[75] Inventor: Takuo Kashiwa, Itami, Japan

[73] Assignee: Mitsubishi Denki Kabushiki Kaisha, Tokyo, Japan

[21] Appl. No.: 764,824

[22] Filed: Sep. 24, 1991

[30] Foreign Application Priority Data

Mar. 20, 1991 [JP] Japan ..... 3-083398

[51] Int. Cl.[5] ..... H01P 5/08

[52] U.S. Cl. ..... 333/33; 330/277; 330/305

[58] Field of Search ..... 333/32, 33, 161, 164; 330/277, 305

[56] References Cited

U.S. PATENT DOCUMENTS 3,546,636 12/1970 Di Piazza ..... 333/164
5,065,117 11/1991 Yoshimasu ..... 333/33

FOREIGN PATENT DOCUMENTS 79803 5/1985 Japan ..... 333/32
2-195701 8/1990 Japan .

OTHER PUBLICATIONS

Kashiwa et al., "X-Band Variable Frequency MMIC Amplifier", 1990 Autumn National Convention Record, The Institute of Electronics, Information and Communication Engineers, Hiroshima Institute of Technology, Oct. 1-4, 1990.

*Primary Examiner*—Paul Gensler
*Attorney, Agent, or Firm*—Leydig, Voit & Mayer

[57] ABSTRACT

A microwave integrated circuit includes a matching circuits. The microwave integrated circuit includes a main transmission line having a strip line and a shorted stub or an open stub, all of which are arranged on a semiconductor substrate. A phase control circuit connected in parallel with the main transmission line controls the passing phase of the main transmission line. Therefore, the electrical length of the main line can be changed and the passing phase through the main line can be controlled for adjusting impedance matching in accordance with changes in the impedance of the element to be matched, resulting in precise impedance matching at a desired frequency.

9 Claims, 4 Drawing Sheets

MICROWAVE INTEGRATED CIRCUIT DEVICE HAVING IMPEDANCE MATCHING

FIELD OF THE INVENTION

The present invention relates to a microwave integrated circuit device and, more particularly, to an improved input/output matching circuit of a high frequency circuit in which an FET is employed.

SUMMARY OF THE INVENTION

A matching circuit of a prior art high frequency circuit comprises transmission lines such as a strip line, an open stub, and a short stub. FIG. 5 is a block diagram illustrating a matching circuit of a prior art microwave integrated circuit device. In FIG. 5, a high frequency input terminal 1 is connected to a first D.C. blocking capacitor 2. One end of a stub 3 is shorted connected to the junction between the first D.C. blocking capacitor 2 and a main line 4 and the other end is connected to the earth via a second D.C. blocking capacitor 2. Reference numeral 5 designates an FET having a gate connected to the main line 4, one main electrode connected to an output matching circuit 6 and the other main electrode connected to the earth. A high frequency output terminal 7 is connected to the output matching circuit 6. A gate bias terminal 8 applies a voltage to the gate of the FET 5. The elements which are provided between the input terminal 1 and the FET 5 constitute an input side matching circuit.

A description will be given of an operation.

FIG. 6 is a Smith chart showing the manner of impedance conversion by the input side matching circuit of FIG. 5. The input impedance A of the FET 5 is converted to an impedance B by the strip main line 4 and further to a desired impedance C (herein, 50Ω) by the shorted stub 3. Herein, the D.C. blocking capacitor 2 does not affect the matching. As described above, the input impedance A at the gate electrode of the FET 5 is converted to the impedance C (50Ω) at the first D.C. blocking capacitor 2 connected to the input terminal 1 and the shorted stub 3. The Smith chart used here is normalized for 50Ω.

In the matching circuit of the prior art microwave integrated circuit device which is constituted as described above, the matching is carried out for a fixed impedance by the matching circuit. When the impedance A of the side to be matched such as the FET 5, varies due to a production or temperature variation, for example, to A' shown in FIG. 6, the impedance matching is carried out as shown by the dotted line of FIG. 6. Then, a desired impedance is not obtained because adjustment of matching point (length) is impossible. In addition, the matching of multiple impedances cannot be performed by the same matching circuit because the impedance to be matched is fixed, and it was necessary to provide a plurality of matching circuits for the respective impedances to be matched.

SUMMARY OF THE INVENTION

It is an object of the present invention to provide a microwave integrated circuit device for adjusting the matching length even in a case where the impedance of the element to be matched such as an FET, varies.

It is another object of the present invention to provide a microwave integrated circuit device for obtaining multiple desired matching points and matching an input impedance and output impedance independently.

Other objects and advantages of the present invention will become apparent from the detailed description given hereinafter; it should be understood, however, that the detailed description and specific embodiment are given by way of illustration only, since various changes and modifications within the spirit and the scope of the invention will become apparent to those skilled in the art from this detailed description.

According to an aspect of the present invention, a phase control circuit that can change the electrical length of a strip main line is provided in a matching circuit of a microwave integrated circuit device. Therefore, when the impedance of the element to be matched such as an FET varies, it is possible to carry out an impedance conversion to a desired value.

According to another aspect of the present invention, a dual gate FET having a good isolation characteristic is employed for signal processing between an input matching circuit and an output matching circuit and phase control means for controlling the passing phase in the main line of the matching circuit is provided at both or either of the input and output side matching circuits. Therefore, it is possible to match the input and output impedances independently, thereby obtaining multiple matching points in the same matching circuit.

DETAILED DESCRIPTION OF THE PREFERRED EMBODIMENT

An embodiment of the present invention will be described in detail with reference to the drawings.

Figure 1:
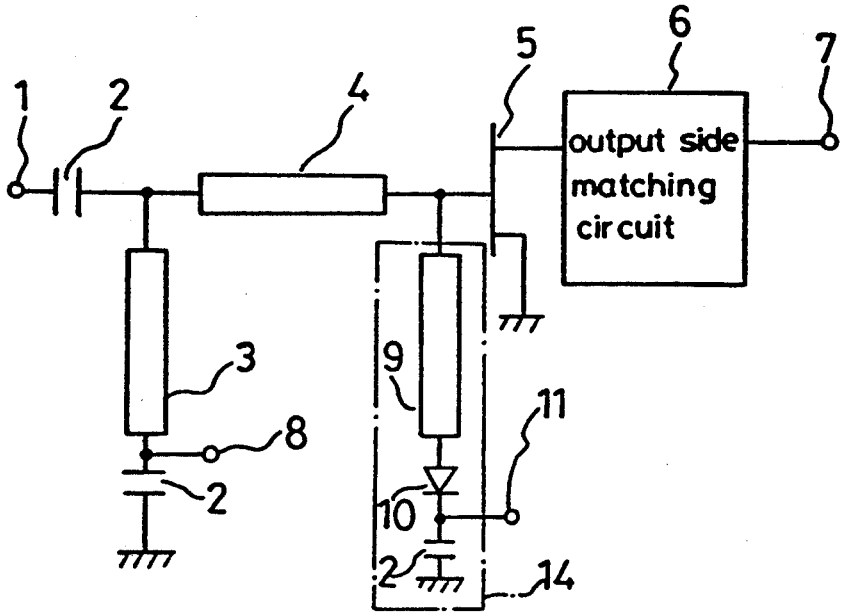
FIG. 1 is a circuit diagram illustrating a microwave integrated circuit device in accordance with an embodiment of the present invention.
Figure 5:
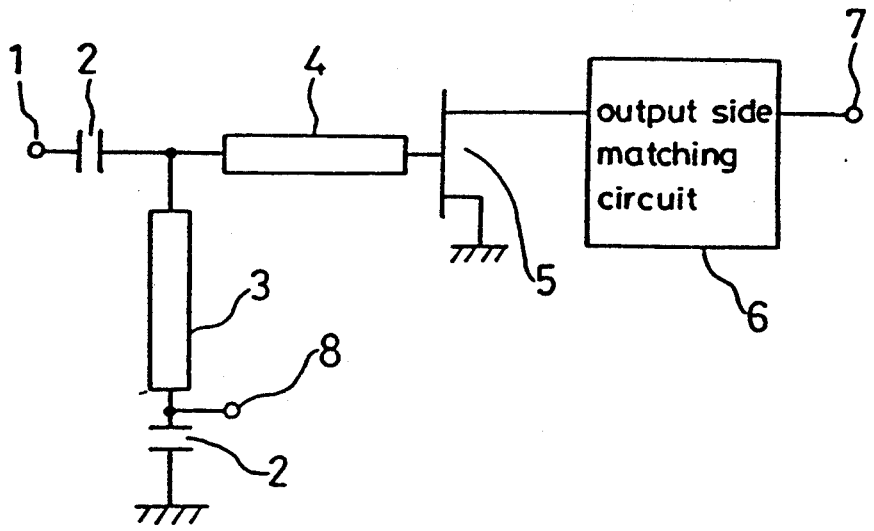
FIG. 5 (PRIOR ART)
FIG. 5 is a circuit diagram illustrating a prior art microwave integrated circuit device.
Figure 6:
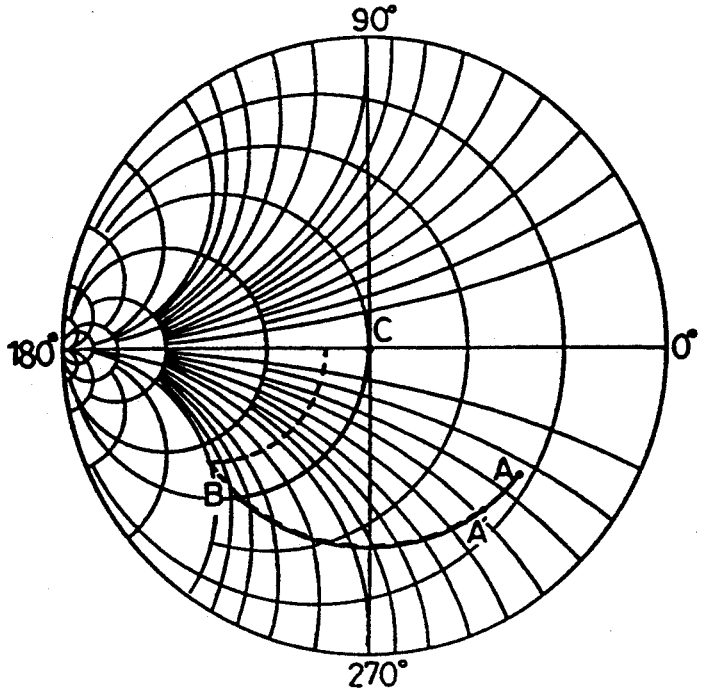
FIG. 6 (PRIOR ART)
FIG. 6 is a Smith chart illustrating impedance conversion in the prior art microwave integrated circuit device.

FIG. 1 is a block diagram illustrating a circuit construction of a microwave integrated circuit device having a matching circuit in accordance with an embodiment of present invention. In FIG. 1, the same reference numerals as those of FIG. 5 designate the same or corresponding elements. Reference numeral 14 designates a phase control circuit comprising a strip line 9, a diode 10, a first D.C. blocking capacitor 2, and a bias terminal 11 of the diode 10. One end of the phase control circuit 14 is connected to the junction between the FET 5 and the main line 4 and the other end thereof is grounded.

Figure 2:
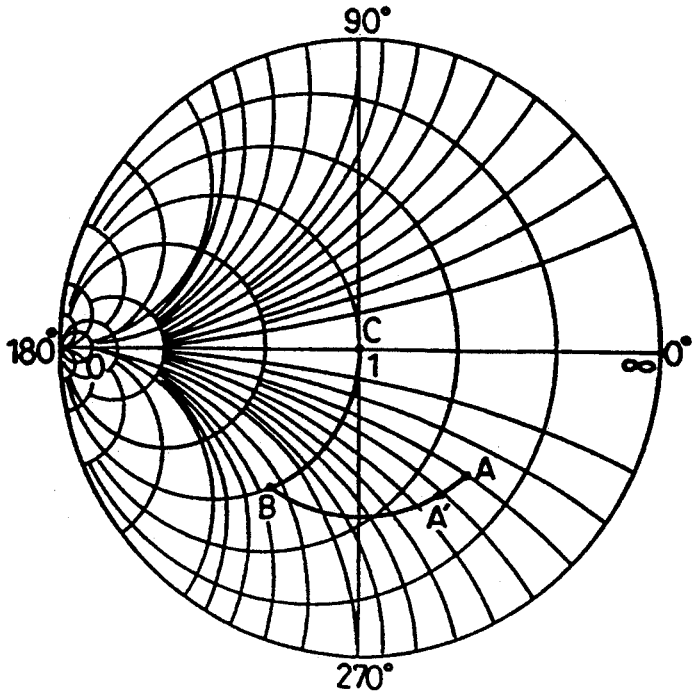
FIG. 2 is a Smith chart illustrating an impedance conversion in the microwave integrated circuit device of FIG. 1.

An impedance conversion carried out by the matching circuit of the microwave integrated circuit device of this embodiment will be described with reference to the Smith chart of FIG. 2.

When the impedance of the FET 5 varies from A to A' the susceptance of the phase control circuit 14 is varied by varying the bias value of the diode 10 using the bias terminal 11, so that the passing phase of the main line 4 is controlled. Thus, the electrical length of the main line 4 is varied in accordance with the change of the input impedance of the FET 5, resulting in the impedance B matched against the input impedance A'. Then, the impedance B is converted to an impedance (50Ω) by the shorted stub 3.

In the above-described embodiment, the series circuit (phase control circuit 14) comprising the strip line 9 and the diode 10 is provided between the FET 5 and the main line 4, and the electrical length of the main line 4 is electrically varied as the bias voltage of the diode 10 is changed in accordance with the change of the input impedance of the FET 5. Therefore, even when the impedance of the FET 5 varies, the impedance can be adjusted to obtain a desired match.

Another embodiment of the present invention will be described.

Figure 3:
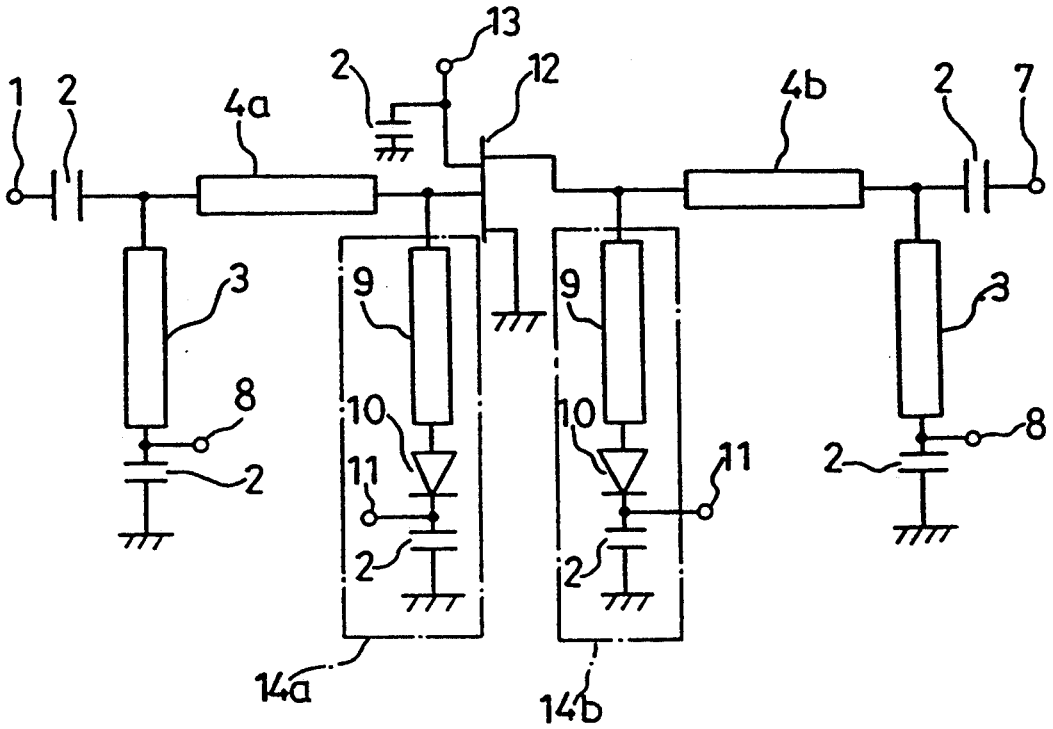
FIG. 3 is a circuit diagram illustrating a microwave integrated circuit device in accordance with another embodiment of the present invention.

FIG. 3 is a block diagram illustrating a circuit construction of a microwave integrated circuit device in accordance with another embodiment of the present invention. As shown in FIG. 3, an amplifier includes a phase control circuit 14*a*, provided between the input terminal 1 and the FET serving as a signal processing part for controlling the passing phase of the input main line 4*a* and another phase control circuit 14*b* for controlling the passing phase of the output side main line 4*b*. Further, a dual gate FET 12 having a good isolation characteristic is employed as the FET, whereby the input and output impedances can be independently controlled. A gate bias terminal 13 is connected to one of the two gate electrodes of the dual gate FET 12 and the amplification factor of the FET 12 is changed in accordance with the voltage applied to the gate bias terminal 13.

Figure 4:
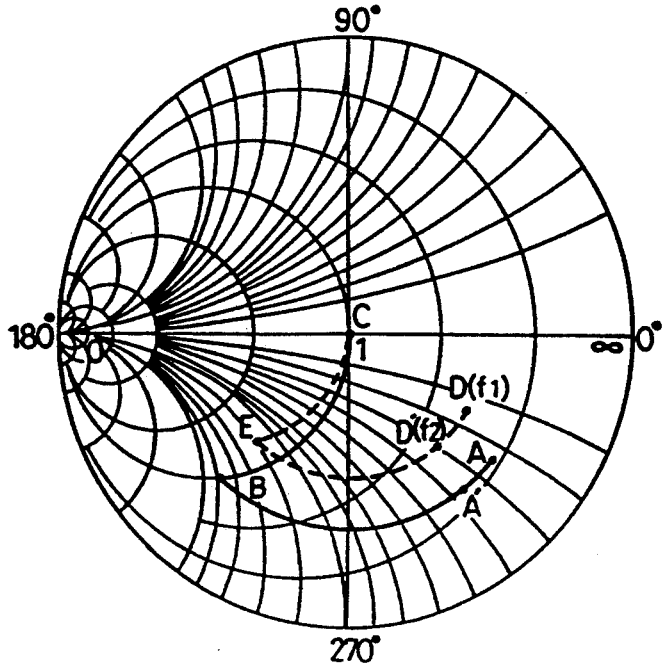
FIG. 4 is a Smith chart illustrating an impedance conversion in the microwave integrated circuit device of FIG. 3.

A description is given of the operation using the Smith impedance chart of FIG. 4.

In this embodiment, the phase control can be performed at input and output independently through the isolation characteristic of the dual gate FET 12. Also, impedance matching can be performed at a plurality of frequencies for any impedance of the FET because the matching length can be changed by varying the bias voltage. For example, when the impedance of the input matching circuit is A and the impedance of the output matching circuit is D, the matching at input side, which is carried out against the impedance A at the frequency $f_1$, is carried out against the impedance A' at the frequency $f_2$ by varying the bias applied to the diode 10 of the phase control circuit 14*a*. Thereafter, the impedance B is converted into a desired impedance C by the input shorted stub 3. At the output, the matching, which is to be carried out against the impedance D at the frequency $f_1$, is carried out against the impedance D' at the frequency $f_2$ similarly as in the input, thereby matching the impedances at a plurality of frequencies. In this operation, the phase control at the input and the output need not be carried out at the same time. Phase control may be carried out at one of the input and output first and then at the other, because the dual gate FET 12 has a good isolation characteristic and the impedance matching of the input and output matching circuit do not influence each other. The matching circuit having such construction can easily match the input and output impedances to obtain a desired impedance value with a simple circuit design.

While in the above-described embodiment, the phase control circuit 14 is provided at each of the input and output, the phase control circuit may be provided at either of input and output.

In the above-described embodiment, the phase control circuit 14 is arranged on a line between the main line 4 of the matching circuit and the FET, but the position of phase control circuit 14 is not limited to this and may be any place on a line between the FET and the input terminal 1 (output terminal 7).

Figure 7:
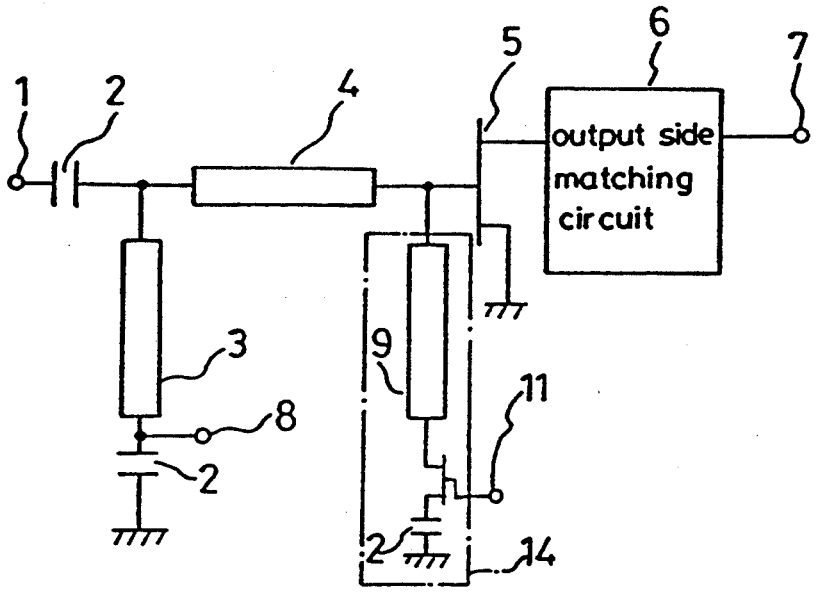
FIG. 7 is a circuit diagram illustrating a microwave integrated circuit device in accordance with an embodiment of the present invention.
Figure 8:
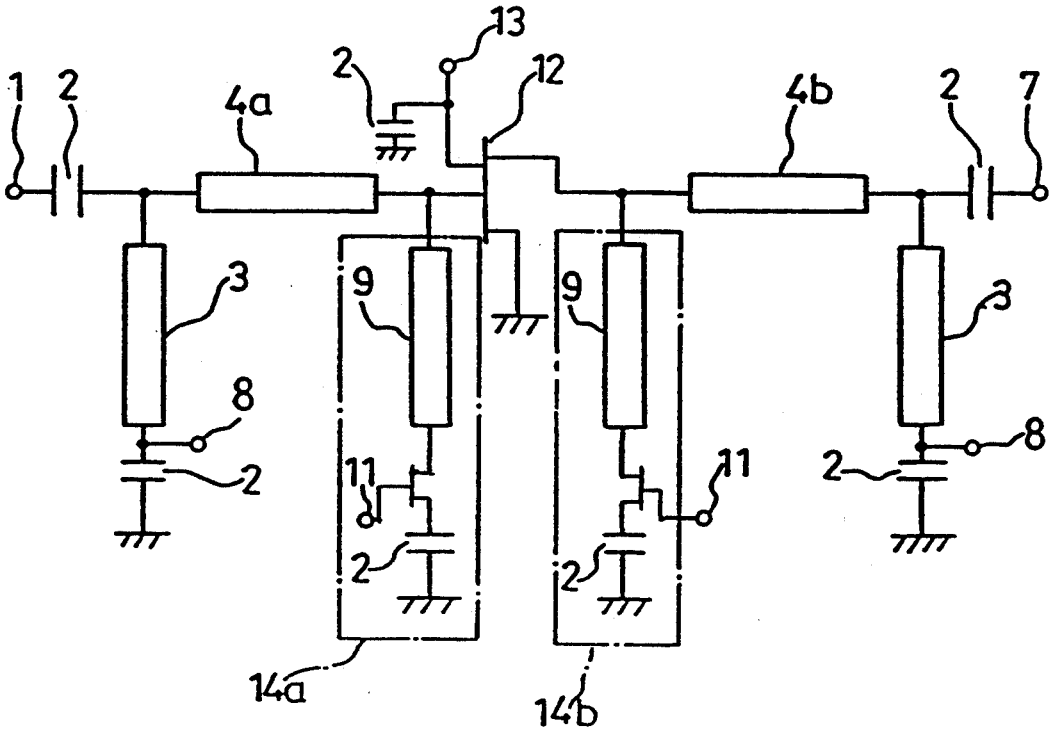
FIG. 8 is a circuit diagram illustrating a microwave integrated circuit device in accordance with an embodiment of the present invention.

Furthermore, while in the above-described embodiments the phase control circuit 14 comprises a strip line and a diode, it may comprise an FET instead of the diode as shown in FIGS. 7 and 8, with the same effects.

As is evident from the foregoing description, according to the present invention, a phase control circuit is provided at a matching circuit of a microwave integrated circuit device for changing the electrical length of a main strip line and for controlling the passing phase of the main line, thereby adjusting the matching in accordance with a change of the impedance of the element to be matched. This results in a highly precise impedance match at a desired frequency.

Furthermore, according to the present invention, a dual gate FET having a good isolation characteristic is employed for a signal processing between the input and the output matching circuits and phase control means for controlling the passing phase of the main line including the matching circuits at both or either of the input and output matching circuits, whereby the input and output impedances can be independently matched with a simple circuit design. In addition, the frequency of the impedance matching can be changed, thereby enabling precise impedance matching at multiple frequencies.

What is claimed is:

1. A microwave integrated circuit comprising:

an input terminal;

signal processing means electrically connected to said input terminal for processing a signal applied to said input terminal;

an input impedance matching circuit electrically connected to and between said input terminal and said signal processing means and including (i) a main transmission line comprising a strip line having an input end, an output end, an impedance, and a phase shift and connected to said input terminal at said input end and to said signal processing means at said output end and (ii) one of a shorted stub and an open stub connected to said input terminal and to said input end of said main transmission line, said main transmission line and stub being arranged on a semiconductor substrate; and phase control means connected in parallel with and to said main transmission line and to said signal processing means for controlling the phase shift of said main transmission line wherein said signal processing means comprises a field effect transistor.

2. The microwave integrated circuit of claim 1 wherein said phase control means comprises a series circuit comprising a strip line and an FET.

3. The microwave integrated circuit of claim 1 wherein said phase control means comprises a series circuit comprising a strip line and a diode.

4. A microwave integrated circuit comprising:

an input terminal;

signal processing means electrically connected to said input terminal for processing a signal applied to said input terminal;

an input impedance matching circuit connected to and between said input terminal and said signal processing means, said input matching circuit including a main transmission line having an input end connected to said input terminal and an output end connected to said signal processing means and having a phase shift;

an output terminal electrically connected to said signal processing means for outputting a signal processed by said signal processing means;

an output impedance matching circuit electrically connected to and between said signal processing means and said output terminal, said output matching circuit including a main transmission line having an input end connected to said signal processing means and an output end connected to said output terminal and having a phase shift; and phase control means connected to said signal processing means and to at least one of said input end of said main transmission line of said output matching circuit and said output end of said main transmission line of said input matching circuit for controlling the phase shift of the main transmission line of the respective matching circuit to which said phase control means is connected wherein said signal processing means comprises a dual-gate FET.

5. The microwave integrated circuit of claim 4 wherein said phase control means comprises a series circuit, comprising a transmission line and an FET, connected in parallel with a main line.

6. The microwave integrated circuit of claim 4 wherein said phase control means comprises a series circuit, comprising a transmission line and a diode, connected in parallel with a main line.

7. The microwave integrated circuit of claim 4 wherein said phase control means comprises a first phase control circuit connected to said output end of said main transmission line of said input impedance matching circuit and to said dual-gate FET and a second phase control circuit connected to said input end of said main transmission line of said output impedance matching circuit and to said dual-gate FET.

8. The microwave integrated circuit of claim 4 wherein said input impedance matching circuit includes one of an open and shorted stub connected to said input terminal and to said input end of said main transmission line of said input impedance matching circuit.

9. The microwave integrated circuit of claim 4 wherein said output impedance matching circuit includes one of an open and shorted stub connected to said output terminal and to said input end of said main transmission line of said output impedance matching circuit.

* * * * *